US006908404B1

(12) United States Patent
Gard

(10) Patent No.: US 6,908,404 B1
(45) Date of Patent: Jun. 21, 2005

(54) CADDY

(76) Inventor: Adam Gard, 333 Andover Dr. apt. 233, Burbank, CA (US) 91504

( * ) Notice: Subject to any disclaimer, the term of this patent is extended or adjusted under 35 U.S.C. 154(b) by 0 days.

(21) Appl. No.: 10/743,182

(22) Filed: Dec. 22, 2003

(51) Int. Cl.[7] ..... A63B 57/00
(52) U.S. Cl. ..... 473/407; 473/353
(58) Field of Search ..... 473/152, 351, 473/353, 407, 570–571

(56) References Cited

U.S. PATENT DOCUMENTS 5,910,057 A * 6/1999 Quimby et al. ..... 473/353
6,113,504 A * 9/2000 Kuesters ..... 473/353
2002/0188359 A1 * 12/2002 Morse ..... 700/91

* cited by examiner

*Primary Examiner*—Kim Nguyen
(74) *Attorney, Agent, or Firm*—Michael I. Kroll

(57) ABSTRACT

The present invention discloses a positioning system for determining the position of a golf ball. The golf ball positioning system includes a golf ball having a first transmitter positioned therein for transmitting a position signal. The system further includes a detection until having a first processor, a first receiver and a display. The first receiver and display are both connected to the first processor. The position signal is transmitted by the transmitter and is received by the first receiver and processed by the first processor. Upon processing the position signal, directional instructions are generated for display on the display and provide aid to the user in locating the position of the golf ball.

7 Claims, 9 Drawing Sheets

CADDY

BACKGROUND OF THE INVENTION

1. Field of the Invention

The present invention relates generally to positioning systems, and more specifically, to a positioning system that detects the position of a golf ball on a golf course. The positioning system includes a golf ball having a computer chip with a transmitter and receiver able to receive signal having a unique frequency. A map unit assigns the frequency the ball and upon the ball being hit, the map unit displays directional instructions to a handheld unit retained by the user to assist the user in locating the position of the golf ball.

2. Description of the Prior Art

Numerous other positioning systems exist in the prior art. Generally, these prior art positioning systems includes a computerized device that send information to and receive information from a satellite which allows the person to be located and tracked by a third party. These global positioning systems are used often in tracking the path of employees who travel, often during the course of their work. These systems are also used by avid outdoor hikers in their travels. However, there are no short range positioning systems that make use of a radio frequency to detect the position of a golf ball.

SUMMARY OF THE PRESENT INVENTION

The present invention relates generally to positioning systems, and more specifically, to a positioning system that detects the position of a golf ball on a golf course. The positioning system includes a golf ball having a computer chip with a transmitter and receiver able to receive signal having a unique frequency. A map unit assigns the frequency the ball and upon the ball being hit, the map unit displays directional instructions to a handheld unit retained by the user to assist the user in locating the position of the golf ball.

A primary object of the present invention is to provide a golf ball positioning system that overcomes the shortcomings of the prior art.

Another secondary object of the present invention is to provide a golf ball positioning system including a golf ball having a computer chip therein.

Another object of the present invention is to provide a golf ball positioning system wherein the computer chip has a transmitter able to transmit signals at a specific pre-assigned radio frequency.

A further object of the present invention is to provide a golf ball positioning system including a detection unit for receiving signals transmitted by the transmitter in the golf ball.

Still another object of the present invention is to provide a golf ball positioning system wherein the detection unit includes a transmitter and the golf ball includes a receiver for receiving information from the transmitter of the detection unit.

A further object of the present invention is to provide a golf ball positioning system including a detection unit for providing directional instructions for traveling to the location of the golf ball.

Yet another object of the present invention is to provide a golf ball positioning system wherein the detection unit includes a graphical display for displaying a map of the golf course currently being played.

Still another object of the present invention is to provide a golf ball positioning system wherein the detection unit includes an assignment function for selectively programming a frequency associated with a golf ball therein.

Another object of the present invention is to provide a golf ball positioning system wherein the detection unit is able to keep track of a plurality of golf balls each golf ball transmitting signals at a different frequency.

An even further object of the present invention is to provide a golf ball positioning system wherein the graphical display displays the current time, date, and temperature.

Yet a further object of the present invention is to provide a golf ball positioning system wherein the detection unit is able to automatically calculate the score of the golfer 8 playing with the golf ball being tracked.

Still another object of the present invention is to provide a golf ball positioning system wherein the detection unit vibrates when a user is within a predetermined distance of the golf ball.

Another object of the present invention is to provide a golf ball positioning system that is simple and easy to use.

Still yet another object of the present invention is to provide a golf ball positioning system that is inexpensive to manufacture and use.

Additional objects of the present invention will appear as the description proceeds.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
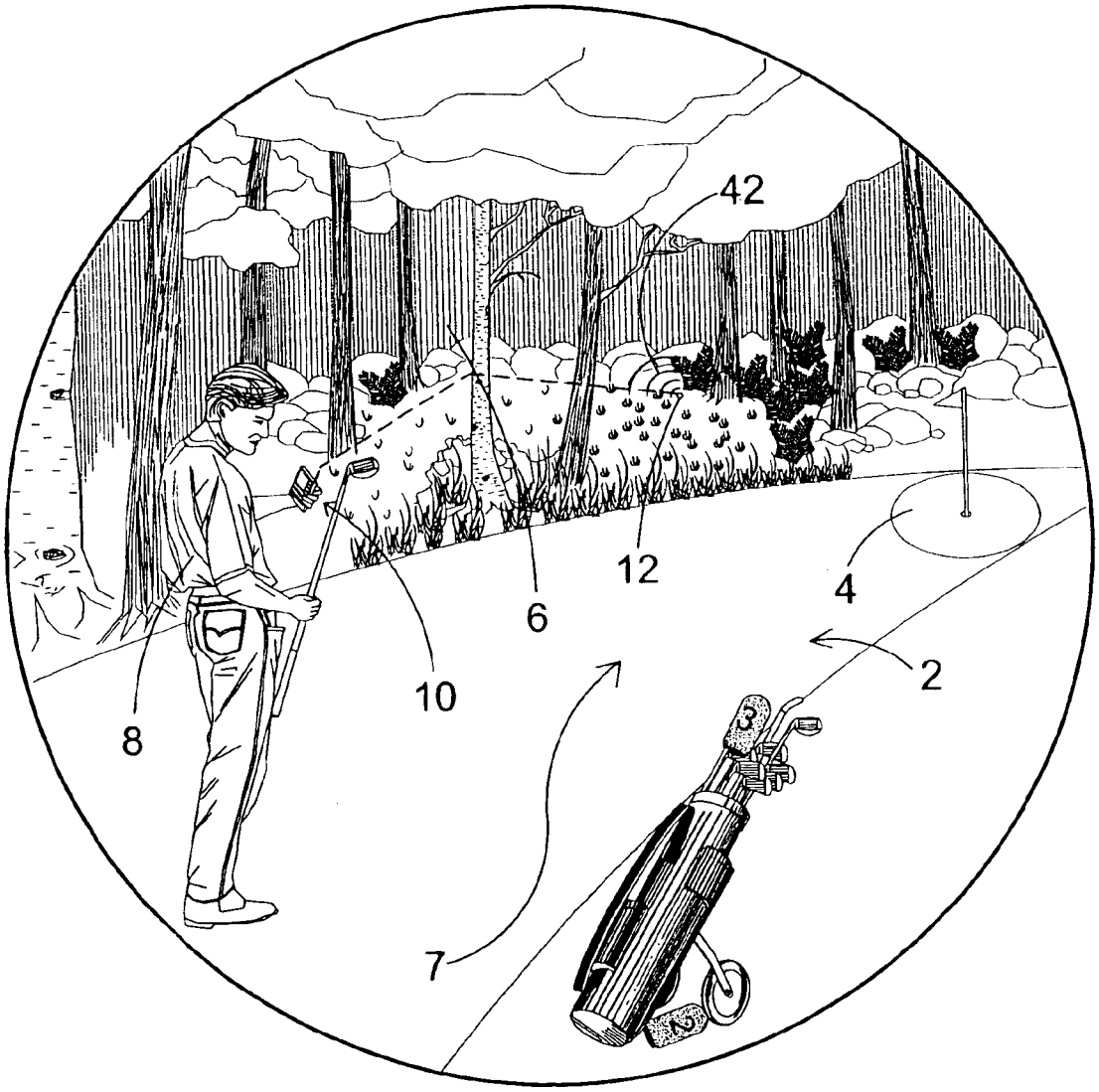
FIG. 1 is an illustrative view of the golf ball positioning system of the present invention being used to determine the position of a golf ball on a golf course.

Turning now descriptively to the drawings, in which similar reference characters denote similar elements throughout the several views, the Figures illustrate the golf ball positioning system of the present invention. With regard to the reference numerals used, the following numbering is used throughout the various drawing figures.

| | |
|---|---|
| 2 | golf course |
| 4 | green |
| 6 | woods |
| 7 | fairway |
| 8 | golfer |
| 10 | golf ball positioning system of the present invention |
| 11 | detection unit |
| 12 | golf ball |
| 13 | computer chip |
| 14 | display |
| 16 | first field |
| 18 | second field |
| 20 | third field |
| 22 | fourth field |
| 24 | map field |
| 26 | first ball |
| 28 | second ball |
| 30 | third ball |
| 32 | fourth ball |
| 34 | number pad |
| 35 | assignment button |
| 36 | power source compartment |
| 38 | antenna |
| 40 | power button |
| 42 | signal of particular frequency |
| 44 | unit processor |
| 46 | receiver |
| 48 | transmitter |
| 50 | card reader |
| 52 | golf ball processor |
| 54 | transmitter |
| 56 | receiver |
| 58 | ROM |
| 60 | RAM |
| 62 | GPS transmitter (detection unit) |
| 64 | GPS receiver (detection unit) |
| 66 | GPS transmitter (golf ball) |
| 68 | GPS receiver (gold ball) |

DETAILED DESCRIPTION OF THE PREFERRED EMBODIMENT

The following discussion describes in detail one embodiment of the invention. This discussion should not be construed, however, as limiting the invention to those particular embodiments. Practitioners skilled in the art will recognize numerous other embodiments as well. For definition of the complete scope of the invention, the reader is directed to appended claims.

Turning now descriptively to the drawings, in which similar reference characters denote similar elements throughout the several views, FIGS. 1 through 9 illustrate a golf ball positioning system of the present invention indicated generally by the numeral 10.

FIG. 1 is an illustrative view of the golf ball positioning system 10 of the present invention being used to determine the position of a golf ball on a golf course 2. Shown in FIG. 1 is a golfer 8 on a golf course 2 looking for a golf ball 12 that has been hit off the fairway 7 into the woods 6. The golfer 8 8 is unsure of the position of the golf ball 12 in relation to a green 4. The golfer 8 uses the golf ball positioning system 10 of the present invention to assist in locating the golf ball 12.

The golf ball positioning system 10 of the present invention includes the golf ball 12 and a detection unit 11. The detection unit 11 is retained by the golfer 8. The golf ball 12 includes a computer chip 13 which is clearly shown in FIG. 5. The computer chip 13 includes a transmitter having a particular frequency associated therewith for transmission of signals assigned thereto. The signal is indicated by the lines labeled with the numeral 42. Upon being hit by the golfer 8, the golf ball 12 emits a signal 42 at the particular frequency therefrom. The detection unit 11 is able to receive and detect the signal 42 emitted by the golf ball 12. Preferably, the detection unit 11 is a handheld unit. However, the detection unit 11 may be formed as any unit that is easily portable, not burdensome, and that does not disturb the golfer 8 during play. Upon receiving the signal 42, the detection unit 12 displays directional instructions to the golfer indicating the direction of travel for the golfer 8 to reach the location of the golf ball 12. When the golfer 8 comes within predetermined distance from the golf ball 12, the detection unit 11 signals the golfer 8 that the golf ball 12 is nearby. Preferably, the detection unit 11 vibrates when the golfer 8 is within the predetermined distance. However, any method to signal the golfer 8 that he/she is within the predetermined range may be used. Upon finding the golf ball 12, the golfer 8 continues playing the round of golf.

Figure 2:
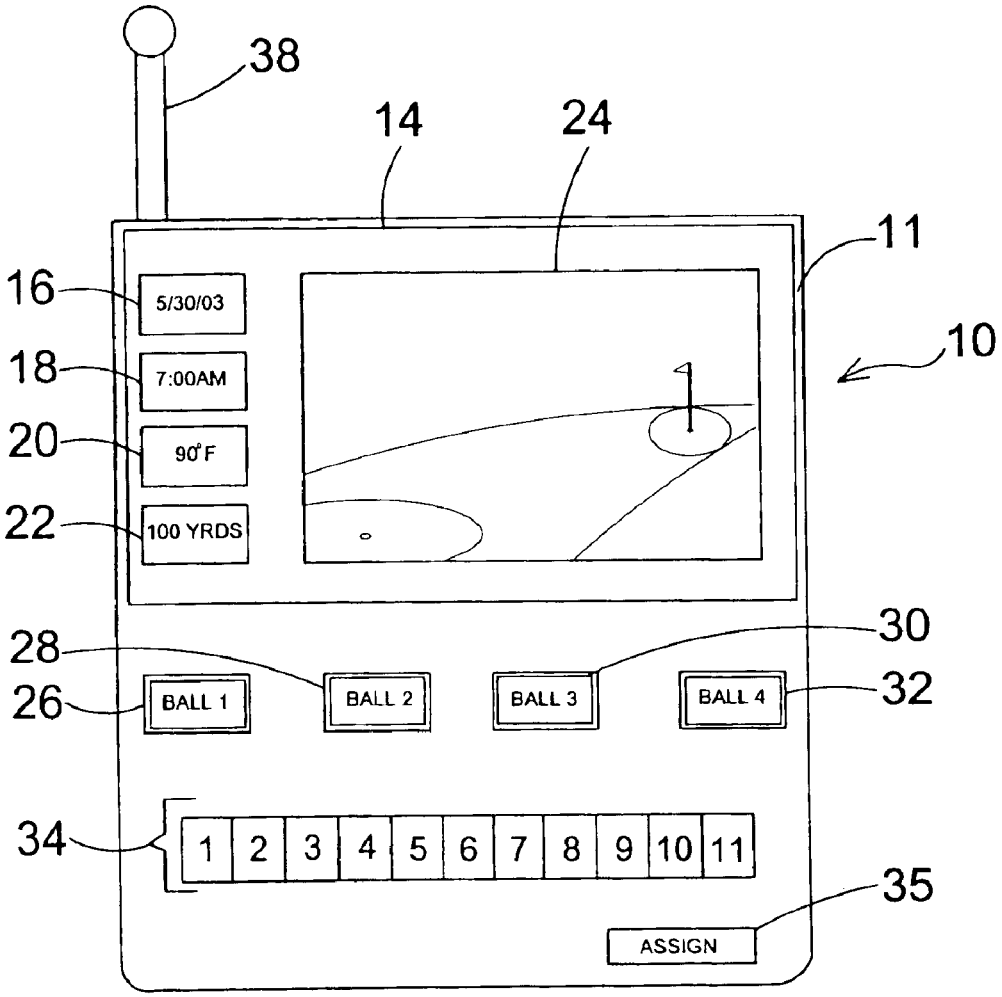
FIG. 2 is front view of the detection unit of the golf ball positioning system of the present invention.

FIG. 2 is front view of the detection unit 11 of the golf ball positioning system 10 of the present invention. The detection unit 11 includes a display screen 14, a numerical keypad 34, an assignment button 35, and an antenna 38. The display screen 14 is able to display a first field 16, a second field 18, a third field 20, a fourth field 22, and a map field 24. The first through fourth fields 16, 18, 20, 22 are able to display data relating to general information which may be useful for the golfer 8. As shown in FIG. 2, the first field 16 displays the date, the second field 18 displays the time, the third field 20 displays the current temperature, and the fourth field 22 displays an approximate distance the golfer 8 is from the golf ball 12. Additionally, the four fields 16, 18, 20, and 22 can be programmed to display a golfer's score, thus enabling the golf ball positioning system 10 of the present invention to display the scores of four different golfers 8. Furthermore, the fields can toggle between displaying two or more sets of data at predetermined intervals.

The map field 24 of the display screen 14 displays a map of the golf course that the golfer 8 is playing on. The map displayed by the map field can be accessed from an expansion card reader 50 which can be clearly seen in FIG. 4. The expansion card reader 50 may be any of but not limited to an input port for connection to an external device, a CD-ROM, a floppy drive, and a DVD-ROM. This enables golfer 8*s* to selectively input data indicative of the course that they are playing on so that the detection unit 11 is able to provide accurate directions to the golfer 8 when the golfer 8 is seeking to determine where the golf ball 12 has landed. The map field 24 is able to display a plurality of views of a specific map of the golf course. The displayable views include at least one of a full course view, an individual hole view, and a view having directional arrows thereon. These views are described for purposes of example only and the map field 24 may selectively display any view of the golf course.

The detection unit 11 is preferably able to track a number of different golf balls 12. In such an instance, a receiver within the detection unit would be able to receive signals having numerous different frequencies either simultaneously or separately. Alternatively, separate receivers would be installed within the detection unit 11. The present example illustrates a detection unit 11 able to receive signals from four different golf balls 12. The detection unit 11 includes a first ball identifier 26, a second ball identifier 28, a third ball identifier 30 and a fourth ball identifier 32. Each ball identifier 26, 28, 30, 32 is selectively programmable by the golfer 8 to correspond to the specific frequency 42 associated with each ball 12. The golfer 8 uses the numerical keypad 34 to input the particular frequency associated with each particular golf ball 12. The golfer 8 selects from the ball identifiers 26, 28, 30, 32 to associate with a golf ball 12 and selectively depresses the selected ball identifier. Thereafter, the golfer 8 enters the frequency 42 into the detection unit 11 using the numerical keypad 34. Upon determining that the correct frequency has been entered, the golfer 8 depresses the assignment button 35 to complete the process and thus allowing the golfer 8 to keep track of the golf ball 12. The golfer 8 may enter the frequency of up to four golf balls 12. However, being able to determine the position of four golf balls is described for purposes of example only and the detection unit 11 may be able to determine the position of any number of golf balls 12. When detecting the position of numerous golf balls individually, the golfer can change the frequency of the receiver by activating a respective one of the ball identifier buttons 26, 28, 30, 32. Activation of these buttons will tune the frequency of the receiver to that frequency being transmitted by the respective ball.

Upon programming the frequency into the detection unit, and hitting the golf ball 12, the antenna 38 selectively detects the frequency 42 emitted by the golf ball 12. Thereafter, the information is processed by a processor and directional instructions are provided to the golfer 8 to assist the golfer 8 in determining the position of the golf ball 12. The map field 24 displays a map of the course corresponding to where the golf ball 12 is indicated and includes directional arrows to assist the golfer 8 in locating the golf ball 12. Upon entering within a pre-determined distance from the golf ball 12, the detection unit 11 provides an indication to the golfer 8 that golf ball 12 is nearby. When the golfer 8 locates the position of the ball 12, the golfer 8 may continue playing the round of golf.

Figure 3:
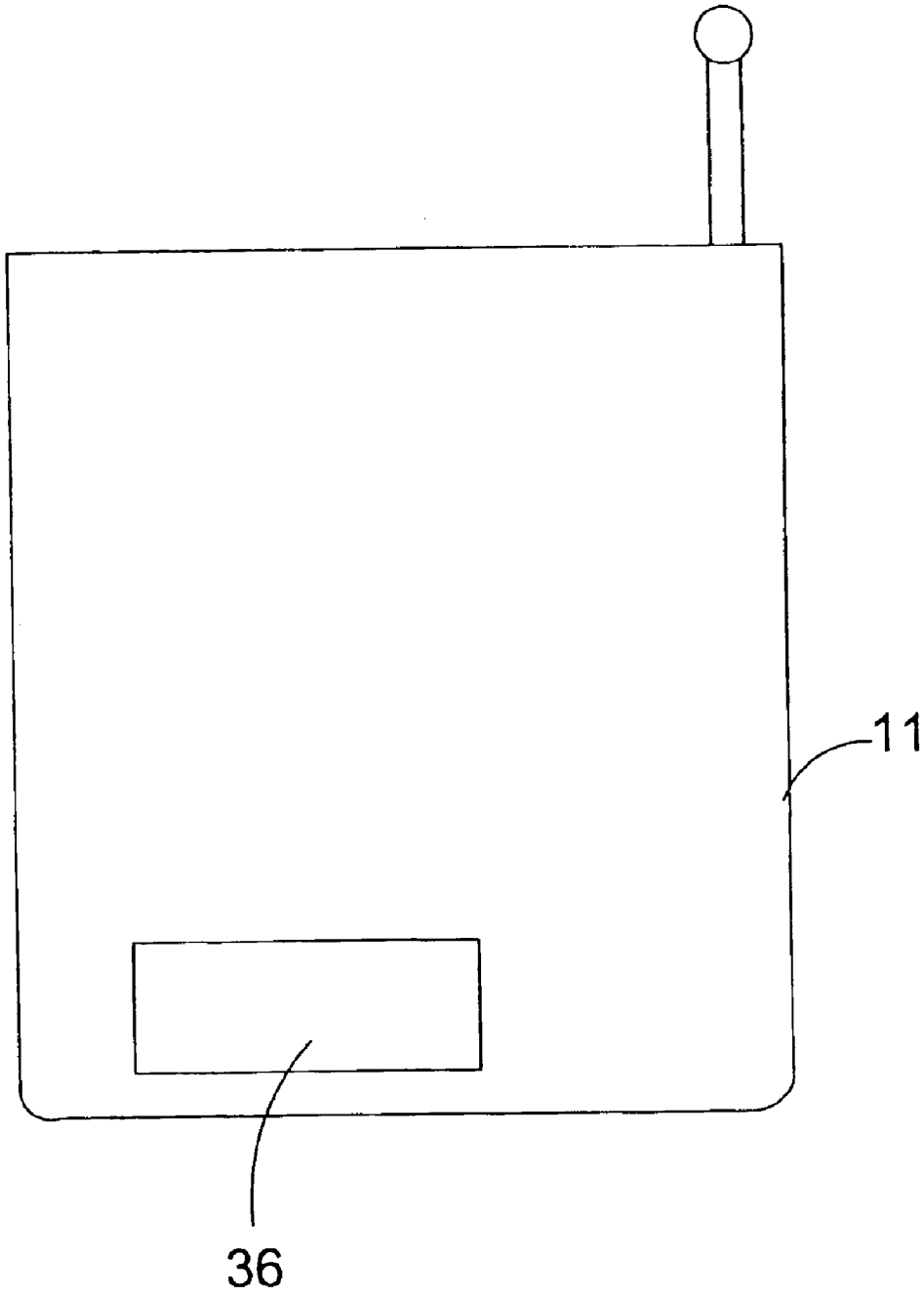
FIG. 3 is rear view of the detection unit of the golf ball positioning system of the present invention.

FIG. 3 is rear view of the detection unit of the golf ball positioning system of the present invention. The detection unit 11 includes the display screen 14, the numerical keypad 34, the assignment button 35, and the antenna 38. The display screen 14 is able to display the first field 16, the second field 18, the third field 20, the fourth field 22, and the map field 24. The first through fourth fields 16, 18, 20, 22 are able to display data relating to general information which may be useful for the golfer 8. As shown in FIG. 2, the first field 16 displays the date, the second field 18 displays the time, the third field 20 displays the current temperature, and the fourth field 22 displays an approximate distance the golfer 8 is from the golf ball 12. Additionally, the four fields 16, 18, 20, and 22 can be programmed to display a golfer's score, thus enabling the golf ball positioning system 10 of the present invention to display the scores of four different golfers 8. Furthermore, the fields can toggle between displaying two or more sets of data at predetermined intervals.

The map field 24 of the display screen 14 displays a map of the golf course that the golfer 8 is playing on. The map displayed by the map field can be accessed from an expansion card reader 50 which can be clearly seen in FIG. 4. The expansion card reader 50 may be any of but not limited to an input port for connection to an external device, a CD-ROM, a floppy drive, and a DVD-ROM. This enables golfer 8*s* to selectively input data indicative of the course that they are playing on so that the detection unit 11 is able to provide accurate directions to the golfer 8 when the golfer 8 is seeking to determine where the golf ball 12 has landed. The map field 24 is able to display a plurality of views of a specific map of the golf course. The displayable views include at least one of a full course view, an individual hole view, and a view having directional arrows thereon. These views are described for purposes of example only and the map field 24 may selectively display any view of the golf course.

The detection unit 11 is preferably able to track a number of different golf balls 12. In such an instance, the receiver within the detection unit would be able to receive signals having numerous different frequencies either simultaneously or separately. Alternatively, separate receivers would be installed within the detection unit 11. The present example illustrates the detection unit 11 able to receive signals from four different golf balls 12. The detection unit 11 includes the first ball identifier 26, the second ball identifier 28, the third ball identifier 30 and the fourth ball identifier 32. Each ball identifier 26, 28, 30, 32 is selectively programmable by the golfer 8 to correspond to the specific frequency 42 associated with each ball 12. The golfer 8 uses the numerical keypad 34 to input the particular frequency associated with each particular golf ball 12. The golfer 8 selects from the ball identifiers 26, 28, 30, 32 to associate with the golf ball 12 and selectively depresses the selected ball identifier. Thereafter, the golfer 8 enters the frequency 42 into the detection unit 11 using the numerical keypad 34. Upon determining that the correct frequency has been entered, the golfer 8 depresses the assignment button 35 to complete the process and thus allowing the golfer 8 to keep track of the golf ball 12. The golfer 8 may enter the frequency of up to four golf balls 12. However, being able to determine the position of four golf balls is described for purposes of example only and the detection unit 11 may be able to determine the position of any number of golf balls 12. When detecting the position of numerous golf balls individually, the golfer can change the frequency of the receiver by activating a respective one of the ball identifier buttons 26, 28, 30, 32. Activation of these buttons will tune the frequency of the receiver to that frequency being transmitted by the respective ball.

Upon programming the frequency into the detection unit, and hitting the golf ball 12, the antenna 38 selectively detects the frequency 42 emitted by the golf ball 12. Thereafter, the information is processed by the processor and directional instructions are provided to the golfer 8 to assist the golfer 8 in determining the position of the golf ball 12. The map field 24 displays the map of the course corresponding to where the golf ball 12 is indicated and includes directional arrows to assist the golfer 8 in locating the golf ball 12. Upon entering within the pre-determined distance from the golf ball 12, the detection unit 11 provides an indication to the golfer 8 that golf ball 12 is nearby. When the golfer 8 locates the position of the ball 12, the golfer 8 may continue playing the round of golf.

FIG. 3 shows a power source compartment 36 for receiving a power source for powering the detection unit. Preferably, the power source is a dry cell battery that is easily replaceable when the charge therefrom has been extinguished. However, the power source can be any known power source such as, but not limited to, a solar panel or a power input plug for recharging an internal battery.

Figure 4:
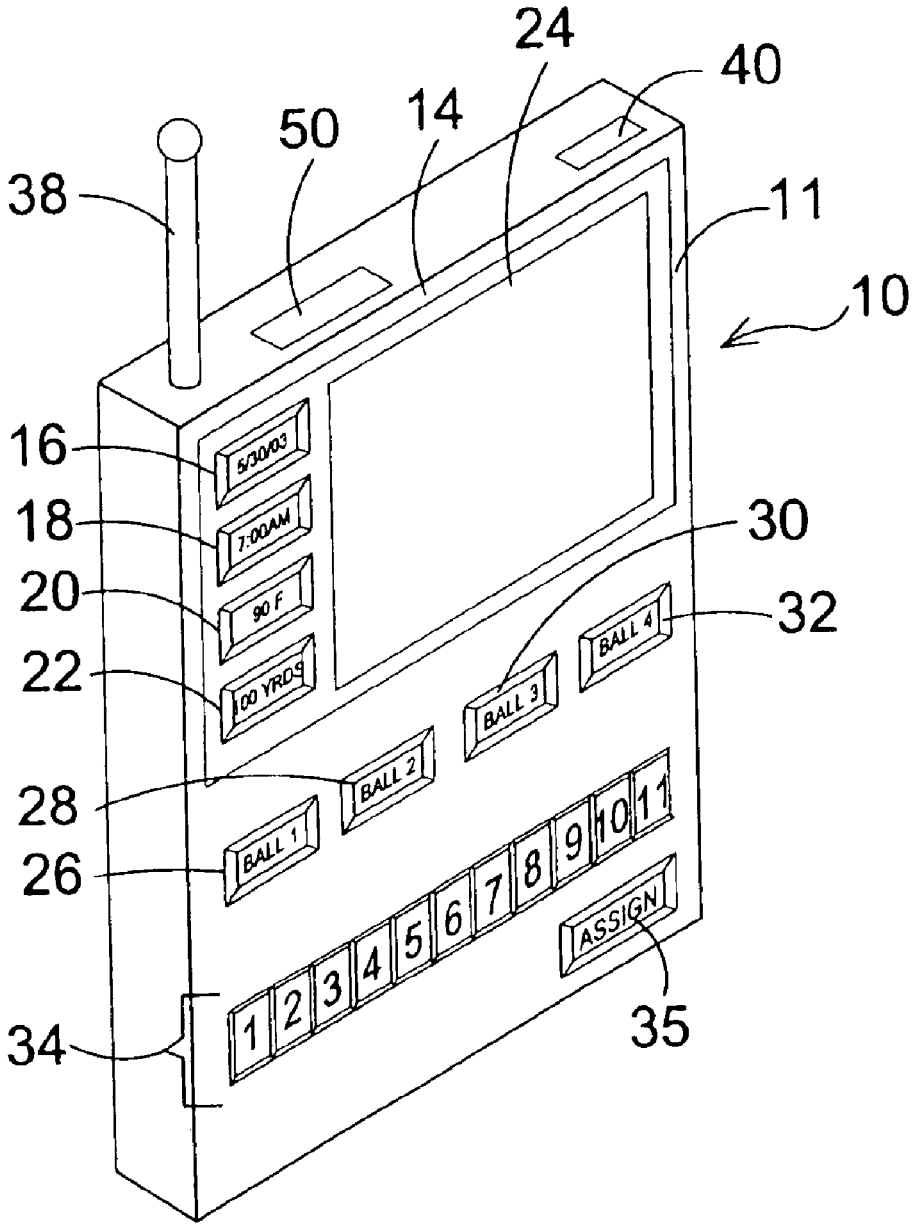
FIG. 4 is a front perspective view of the detection unit of the golf ball positioning system of the present invention.

FIG. 4 is a front perspective view of the detection unit of the golf ball positioning system of the present invention. The detection unit 11 includes the display screen 14, the numerical keypad 34, the assignment button 35, and the antenna 38. The display screen 14 is able to display the first field 16, the second field 18, the third field 20, the fourth field 22, and the map field 24. The first through fourth fields 16, 18, 20, 22 are able to display data relating to general information which may be useful for the golfer 8. As shown in FIG. 2, the first field 16 displays the date, the second field 18 displays the time, the third field 20 displays the current temperature, and the fourth field 22 displays an approximate distance the golfer 8 is from the golf ball 12. Additionally, the four fields 16, 18, 20, and 22 can be programmed to display a golfer's score, thus enabling the golf ball positioning system 10 of the present invention to display the scores of four different golfers 8. Furthermore, the fields can toggle between displaying two or more sets of data at predetermined intervals.

The map field 24 of the display screen 14 displays a map of the golf course that the golfer 8 is playing on. The map displayed by the map field can be accessed from an expansion card reader 50 which can be clearly seen in FIG. 4. The expansion card reader 50 may be any of but not limited to an input port for connection to an external device, a CD-ROM, a floppy drive, and a DVD-ROM. This enables golfer 8*s* to selectively input data indicative of the course that they are playing on so that the detection unit 11 is able to provide accurate directions to the golfer 8 when the golfer 8 is seeking to determine where the golf ball 12 has landed. The map field 24 is able to display a plurality of views of a specific map of the golf course. The displayable views include at least one of a full course view, an individual hole view, and a view having directional arrows thereon. These views are described for purposes of example only and the map field 24 may selectively display any view of the golf course.

The detection unit 11 is preferably able to track a number of different golf balls 12. In such an instance, the receiver within the detection unit would be able to receive signals having numerous different frequencies either simultaneously or separately. Alternatively, separate receivers would be installed within the detection unit 11. The present example illustrates the detection unit 11 able to receive signals from four different golf balls 12. The detection unit 11 includes the first ball identifier 26, the second ball identifier 28, the third ball identifier 30 and the fourth ball identifier 32. Each ball identifier 26, 28, 30, 32 is selectively programmable by the golfer 8 to correspond to the specific frequency 42 associated with each ball 12. The golfer 8 uses the numerical keypad 34 to input the particular frequency associated with each particular golf ball 12. The golfer 8 selects from the ball identifiers 26, 28, 30, 32 to associate with the golf ball 12 and selectively depresses the selected ball identifier. Thereafter, the golfer 8 enters the frequency 42 into the detection unit 11 using the numerical keypad 34. Upon determining that the correct frequency has been entered, the golfer 8 depresses the assignment button 35 to complete the process and thus allowing the golfer 8 to keep track of the golf ball 12. The golfer 8 may enter the frequency of up to four golf balls 12. However, being able to determine the position of four golf balls is described for purposes of example only and the detection unit 11 may be able to determine the position of any number of golf balls 12. When detecting the position of numerous golf balls individually, the golfer can change the frequency of the receiver by activating a respective one of the ball identifier buttons 26, 28, 30, 32. Activation of these buttons will tune the frequency of the receiver to that frequency being transmitted by the respective ball.

Upon programming the frequency into the detection unit, and hitting the golf ball 12, the antenna 38 selectively detects the frequency 42 emitted by the golf ball 12. Thereafter, the information is processed by the processor and directional instructions are provided to the golfer 8 to assist the golfer 8 in determining the position of the golf ball 12. The map field 24 displays the map of the course corresponding to where the golf ball 12 is indicated and includes directional arrows to assist the golfer 8 in locating the golf ball 12. Upon entering within the pre-determined distance from the golf ball 12, the detection unit 11 provides an indication to the golfer 8 that golf ball 12 is nearby. When the golfer 8 locates the position of the ball 12, the golfer 8 may continue playing the round of golf.

The detection unit 11 further includes a power button 40 for selectively providing power to the detection unit 11. The detection unit 11 also includes the expansion card reader 50. The expansion card reader 50 enables the golfer 8 to selectively add information regarding the course 2 on which the golfer 8 is planning to play. The expansion card reader 50 is able to receive a plurality of known mobile storage media including at least one of compact flash memory, secure digital member, smartmedia memory, and memory stick memory. Alternatively, the expansion card reader may be replaced with an input port for connection to an external component able to download data to the detection unit 11. This enables the golfer 8 to obtain information about the golf course from their home personal computer and selectively bring that information with them in order to enhance the detection units' 11 ability to locate the golf ball 12.

Figure 5:
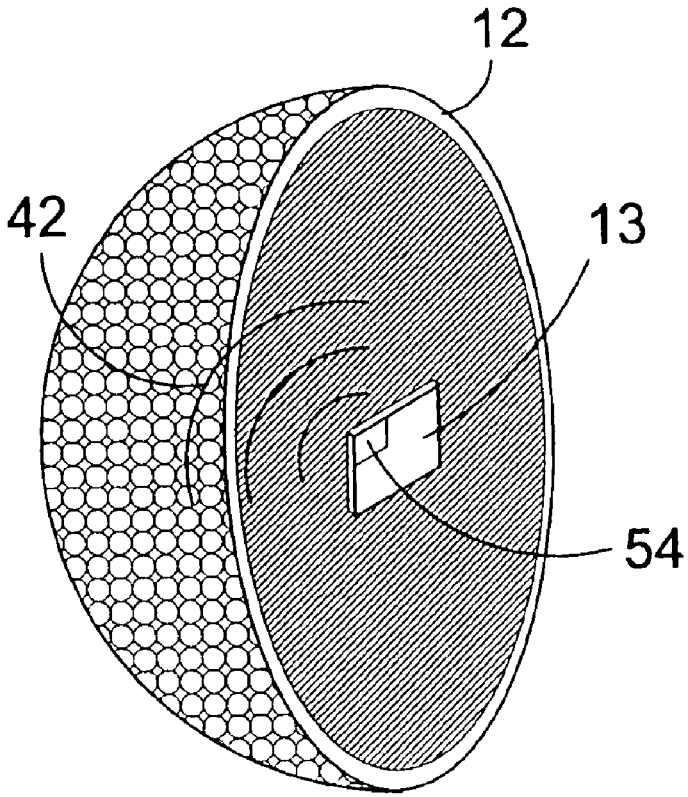
FIG. 5 is a cross-sectional view of the golf ball of the golf ball positioning system of the present invention having a computer chip positioned therein.

FIG. 5 is a cross-sectional view of the golf ball 12 of the golf ball positioning system 10 of the present invention having a computer chip 13 positioned therein. The golf ball 12 includes the chip 13. The chip 13 includes the transmitter for transmitting signals indicated by the lines labeled with the numeral 42 having a predetermined frequency associated therewith. The frequency 42 is preferable displayed on the exterior of the golf ball thereby easily allowing the golfer 8 to ascertain the information needed to be programmed into the detection unit 11 as has been discussed above with specific reference to FIGS. 2–4. The golf ball 12 of the golf ball positioning system 10 is formed from the material known in the art so as to ensure that the golfer 8's game is not altered. The chip 13 is light weight and positioned at substantially the center of the golf ball 12 to ensure that the golf ball 12 remains completely balanced during play. As can be seen from FIG. 7, the chip 13 includes a processor 52, a transmitter 54 and a receiver 56. Both the transmitter 54 and receiver 56 are connected to the processor 52. Also connected to the processor 52 is a ROM 58. The ROM 58 stores the frequency 42 that is associated with the golf ball 12. The receiver 56 is able to receive an assignment signal from the detection unit 11. Upon receiving the assignment signal, the processor 52 directs the transmitter 54 to transmit a signal 42 at the frequency contained within the ROM 58. The transmitter 54 emits the signal at the predetermined frequency which is selectively detectable by the detection unit 11 thus enabling the golfer 8 to located the position of the golf ball 12.

Figure 6:
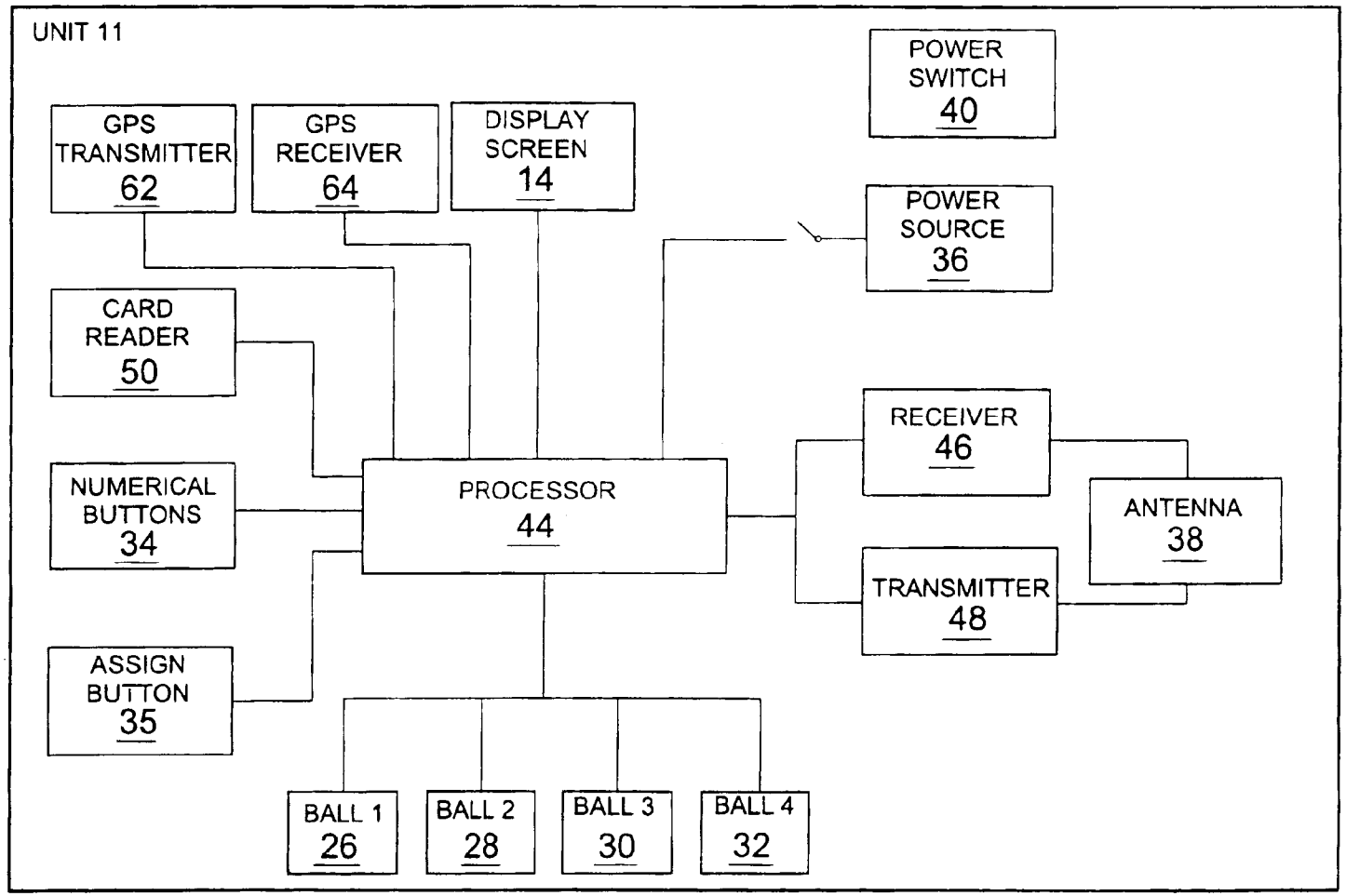
FIG. 6 is a block diagram of the detection unit of the golf ball positioning system of the present invention.

FIG. 6 is a block diagram of the detection unit of the golf ball positioning system of the present invention. The detection unit 111 includes the display screen 14, the numerical keypad 34, the assignment button 35, and the antenna 38.

The display screen 14 is able to display the first field 16, the second field 18, the third field 20, the fourth field 22, and the map field 24. The first through fourth fields 16, 18, 20, 22 are able to display data relating to general information which may be useful for the golfer 8. As shown in FIG. 2, the first field 16 displays the date, the second field 18 displays the time, the third field 20 displays the current temperature, and the fourth field 22 displays an approximate distance the golfer 8 is from the golf ball 12. Additionally, the four fields 16, 18, 20, and 22 can be programmed to display a golfer's score, thus enabling the golf ball positioning system 10 of the present invention to display the scores of four different golfers 8. Furthermore, the fields can toggle between displaying two or more sets of data at predetermined intervals.

The map field 24 of the display screen 14 displays a map of the golf course that the golfer 8 is playing on. The map displayed by the map field can be accessed from an expansion card reader 50 which can be clearly seen in FIG. 4. The expansion card reader 50 may be any of but not limited to an input port for connection to an external device, a CD-ROM, a floppy drive, and a DVD-ROM. This enables golfer 8*s* to selectively input data indicative of the course that they are playing on so that the detection unit 11 is able to provide accurate directions to the golfer 8 when the golfer 8 is seeking to determine where the golf ball 12 has landed. The map field 24 is able to display a plurality of views of a specific map of the golf course. The displayable views include at least one of a full course view, an individual hole view, and a view having directional arrows thereon. These views are described for purposes of example only and the map field 24 may selectively display any view of the golf course.

The detection unit 11 is preferably able to track a number of different golf balls 12. In such an instance, the receiver within the detection unit would be able to receive signals having numerous different frequencies either simultaneously or separately. Alternatively, separate receivers would be installed within the detection unit 11. The present example illustrates the detection unit 11 able to receive signals from four different golf balls 12. The detection unit 11 includes the first ball identifier 26, the second ball identifier 28, the third ball identifier 30 and the fourth ball identifier 32. Each ball identifier 26, 28, 30, 32 is selectively programmable by the golfer 8 to correspond to the specific frequency 42 associated with each ball 12. The golfer 8 uses the numerical keypad 34 to input the particular frequency associated with each particular golf ball 12. The golfer 8 selects from the ball identifiers 26, 28, 30, 32 to associate with the golf ball 12 and selectively depresses the selected ball identifier. Thereafter, the golfer 8 enters the frequency 42 into the detection unit 11 using the numerical keypad 34. Upon determining that the correct frequency has been entered, the golfer 8 depresses the assignment button 35 to complete the process and thus allowing the golfer 8 to keep track of the golf ball 12. The golfer 8 may enter the frequency of up to four golf balls 12. However, being able to determine the position of four golf balls is described for purposes of example only and the detection unit 11 may be able to determine the position of any number of golf balls 12. When detecting the position of numerous golf balls individually, the golfer can change the frequency of the receiver by activating a respective one of the ball identifier buttons 26, 28, 30, 32. Activation of these buttons will tune the frequency of the receiver to that frequency being transmitted by the respective ball.

Upon programming the frequency into the detection unit, and hitting the golf ball 12, the antenna 38 selectively detects the frequency 42 emitted by the golf ball 12. Thereafter, the information is processed by the processor and directional instructions are provided to the golfer 8 to assist the golfer 8 in determining the position of the golf ball 12. The map field 24 displays the map of the course corresponding to where the golf ball 12 is indicated and includes directional arrows to assist the golfer 8 in locating the golf ball 12. Upon entering within the pre-determined distance from the golf ball 12, the detection unit 11 provides an indication to the golfer 8 that golf ball 12 is nearby. When the golfer 8 locates the position of the ball 12, the golfer 8 may continue playing the round of golf.

Additionally, the detection unit 11 may include a global positioning (GPS) transmitter 62 and a global positioning (GPS) receiver 64 both connected to the processor. The GPS transmitter 62 and the GPS receiver 64 are able to communicate with global positioning systems to obtain a position signal. This signal is processed by the processor which is able to display the position of the detection unit 11 on the golf course using the display 14.

Figure 7:
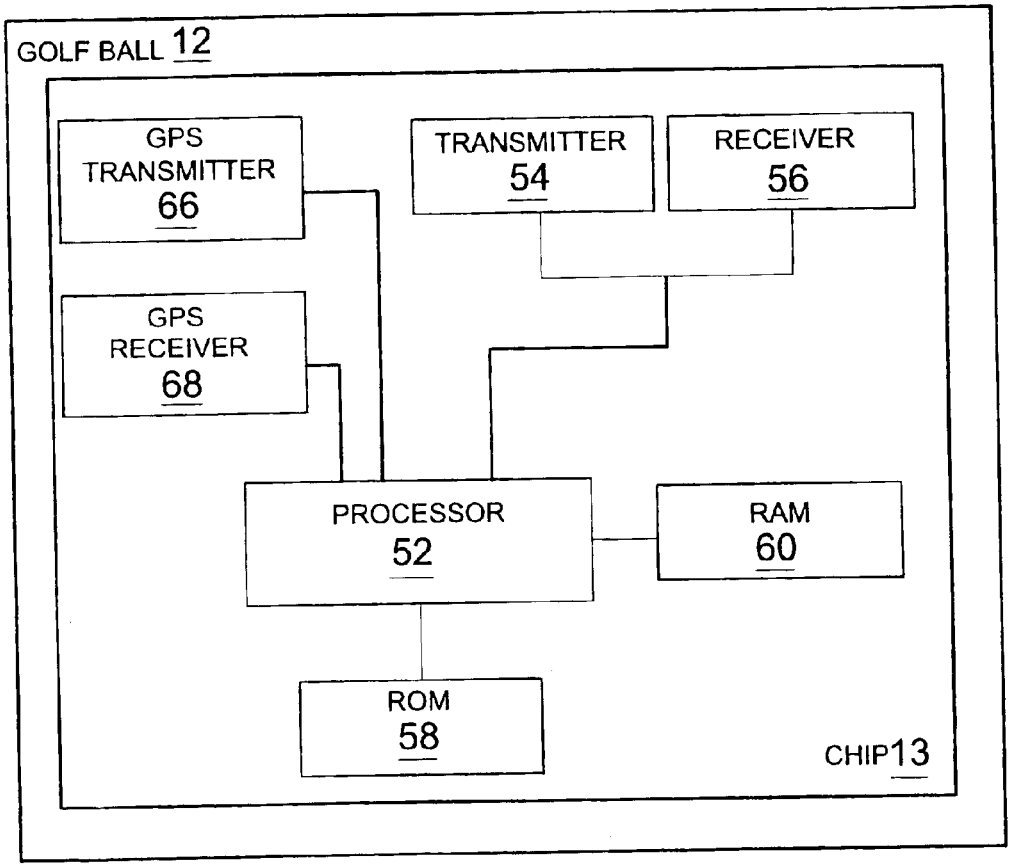
FIG. 7 is a block diagram of the golf ball of the golf ball positioning system of the present invention.

FIG. 7 is a block diagram of the golf ball of the golf ball positioning system of the present invention. The golf ball 12 includes the chip 13. The chip 13 includes transmitter for transmitting signals indicated by the lines labeled with the numeral 42 having a predetermined frequency associated therewith. The frequency 42 is preferable displayed on the exterior of the golf ball thereby easily allowing the golfer 8 to ascertain the information needed to be programmed into the detection unit 11 as has been discussed above with specific reference to FIGS. 2–4. The golf ball 12 of the golf ball positioning system 10 is formed from the material known in the art so as to ensure that the golfer 8's game is not altered. The chip 13 is light weight and positioned at substantially the center of the golf ball 12 to ensure that the golf ball 12 remains completely balanced during play. As can be seen from FIG. 7, the chip 13 includes a processor 52, a transmitter 54 and a receiver 56. Both the transmitter 54 and receiver 56 are connected to the processor 52. Also connected to the processor 52 is a ROM 58. The ROM 58 stores the frequency 42 that is associated with the golf ball 12. The receiver 56 is able to receive an assignment signal from the detection unit 11. Upon receiving the assignment signal, the processor 52 directs the transmitter 54 to transmit a signal 42 at the frequency contained within the ROM 58. The transmitter 54 emits the signal at the predetermined frequency which is selectively detectable by the detection unit 11 thus enabling the golfer 8 to located the position of the golf ball 12.

The golf ball may also include a GPS transmitter 66 and a GPS receiver 68 both connected to the processor 52. The GPS transmitter 66 and GPS receiver 68 are able to communicate with the global positioning system to obtain a position signal for the golf ball 12. This position signal may also be transmitted to the detection unit 11 for display on the map of the golf course 2 which is displayed on the display 14.

Figure 8:
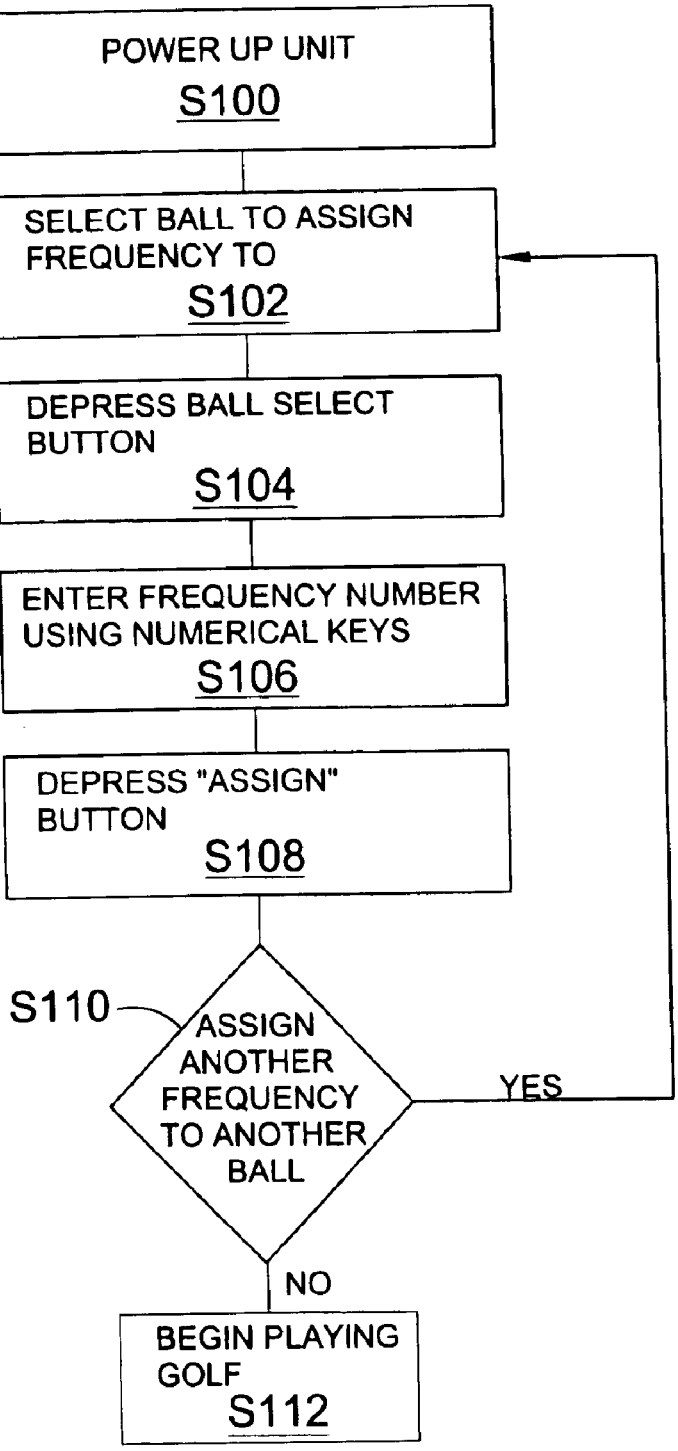
FIG. 8 is a flow chart detailing the steps of assigning a transmission frequency of the transmitter within a golf ball to the detection unit of the golf ball positioning system prior to tracking thereof.

FIG. 8 is a flow chart detailing the steps of assigning a frequency of a signal transmitted from the golf ball to the detection unit of the golf ball positioning system prior to tracking thereof. In order to program the golf ball positioning system to locate the position of a golf ball, the golfer 8 must power up the detection unit as stated in step S100. Thereafter, the golfer 8 must select a golf ball that is to be tracked and located by the golf ball positioning system 10 of the present invention as shown in step S102. The golfer 8 then depressed the ball identifier button which denotes the ball that is being tracked as stated in step S104. Each golf ball of the golf ball positioning system 10 of the present invention is able to transmit a signal at a particular frequency associated therewith. The golfer 8 then uses the numerical keypad on the detection unit to enter the frequency as in step S106. The process of assigning a golf ball to be tracked and located is then completed in step S108 when the golfer 8 depresses the assignment button. The golfer 8 is then faced with the choice of whether or not the golfer 8 desires to track more than one golf ball as shown in step S110. If the golfer 8 desires to track more than one golf ball, then the golfer 8 is direct to return to step S102 and repeat steps S102–S108. If the golfer 8 is finished assigning golf balls to be tracked an located, the golfer 8 begins his/her round of golf a stated in step S112.

Figure 9:
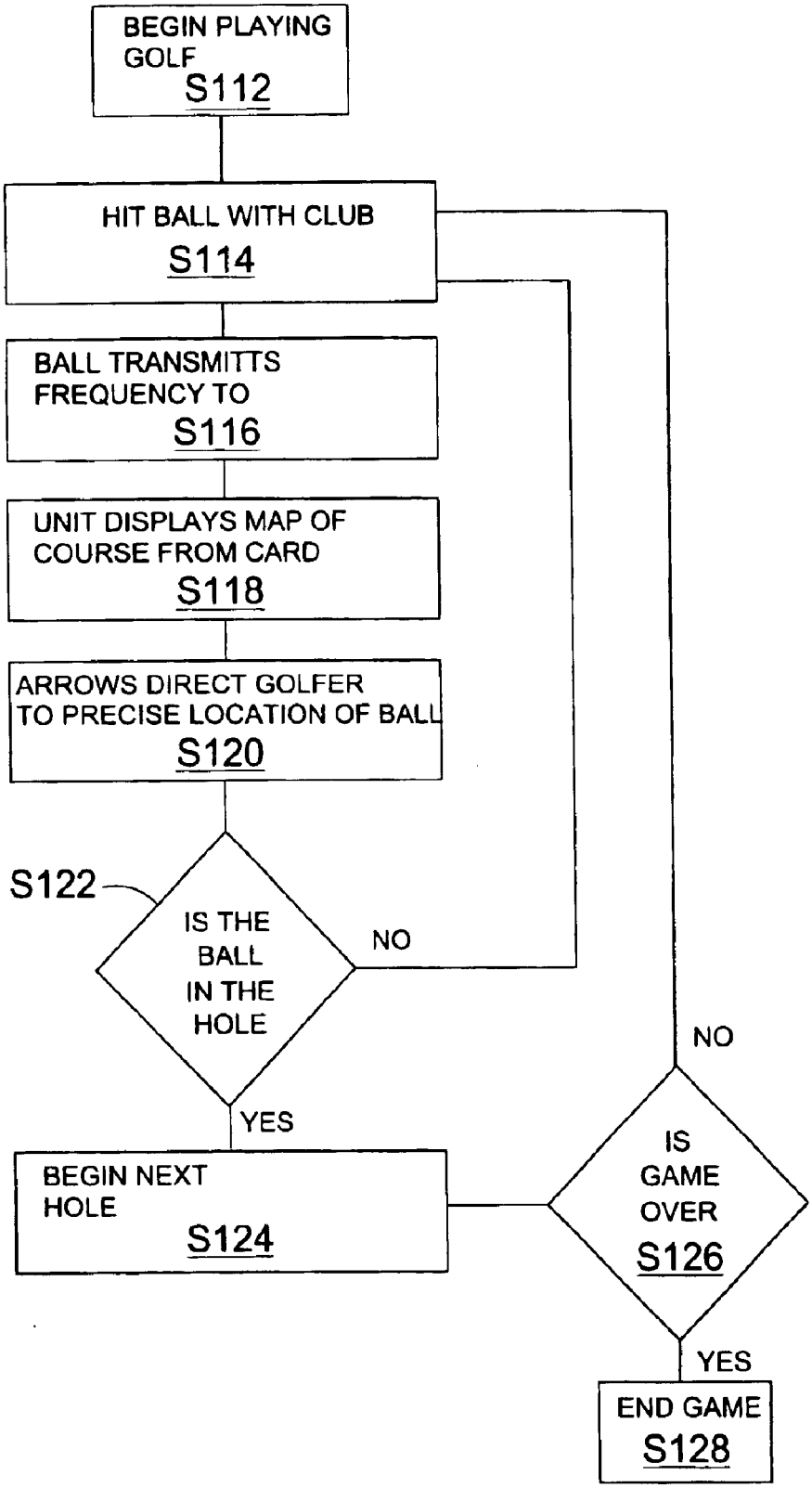
FIG. 9 is a flow chart detailing the steps of tracking the golf ball by the golf ball positioning system of the present invention.

FIG. 9 is a flow chart detailing the steps of tracking the golf ball by the golf ball positioning system of the present invention. FIG. 9 continues directly from step S112 of FIG. 8. The golfer 8 has begun to play the round of golf as stated in step S112. The golfer 8 must hit the ball with the club as shown in step S114. Upon the ball being struck with a club and landing a distance away from the golfer 8, the ball transmits a position signal at the unique frequency associated therewith as in step S116. This signal may also include a GPS position signal. The golfer 8 then consults the detection unit which displays a map of the course which is obtained from an expansion card as in step S118. The display of the detection unit provides the golfer 8 with directional arrows to the precise location of the golf ball as stated in step S120. The golfer 8 must then determine if the golf ball is in the hole as in step S122. If the ball is not in the hole, the golfer 8 is must repeats steps S114–S122 again until the golfer 8 determines that the golf ball is in the hole which leads the golfer 8 to step S124 where the golfer 8 begins the next hole. The golfer 8 must determine if the previous hole was the final hole played as stated in step S126. If the previous hole was not the final hole, then the golfer 8 is directed to repeat steps S114–S126 until the golfer 8 determines that the previous hole was the final hole. Upon determining from step S126 that the previous hole was the final hole, the golfer 8 ends the game as stated in step S128.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A positioning system for determining a position of a golf ball comprising:

a) said golf ball having a first transmitter positioned therein for transmitting a position signal at a frequency unique to said golf ball, a second transmitter using GPS to determine said position, a receiver, a processor and a ROM for storing said frequency;

b) a detection unit having a first processor, a first receiver and a display unit, said first receiver and display both connected to said first processor, wherein said position signal is received by said first receiver and processed by said first processor for generating directional instructions for display on said display unit providing aid to a user in locating the position of said golf ball; and c) said detection unit having a first transmitter for sending a signal to said golf ball assigning said frequency to said golf ball, the receiver in said golf ball receiving said frequency assigning signal and the processor in said golf ball storing said frequency in said ROM, and a second transmitter using GPS to determine and to display a position of said detection unit.

2. The system as recited in claim 1, wherein said display unit includes a plurality of display fields, each display field being capable of showing at least one of a current time, a current temperature, a current date, a map of a golf course, distance from said golf ball, and a golf score.

3. The system as recited in claim 2, wherein said first receiver is able to receive signals having different frequencies thereby allowing receipt of position signals from different golf balls.

4. The system as recited in claim 3, wherein said detection unit further comprises a numerical keypad connected to said first processor for tuning said first receiver to receive said position signal transmitted at said unique frequency and for inputting said frequency to be assigned to said golf ball.

5. The system as recited in claim 4, wherein said detection unit further comprises an expansion card reader for receiving data from a storage medium, said data being indicative of a map on a golf course being played.

6. The system as recited in claim 5, wherein said detection unit further includes means for notifying the user when the golf ball is within a predetermined distance from said detection unit.

7. The system as recited in claim 6, wherein said notifying means generates a vibration signal or a audible signal.

* * * * *